United States Patent [19]

Garrett, Sr.

[11] Patent Number: 5,046,210

[45] Date of Patent: Sep. 10, 1991

[54] WALL MOUNTABLE SHOE SHINING APPARATUS

[76] Inventor: Charles N. Garrett, Sr., 2223 Jumpin Run Dr., Wilmington, N.C. 28403

[21] Appl. No.: 416,053

[22] Filed: Oct. 2, 1989

[51] Int. Cl.[5] ..... A43D 3/00; A47L 23/16; A47L 23/18

[52] U.S. Cl. ..... 12/123; 15/265; 15/267

[58] Field of Search ..... 12/122, 123; 15/266, 15/265, 267

[56] References Cited

U.S. PATENT DOCUMENTS

| | | | |
|---|---|---|---|
| 413,265 | 10/1889 | Smith | 15/265 |
| 443,825 | 12/1890 | Demme | 15/265 |
| 864,954 | 9/1907 | Craig | 15/265 |
| 946,464 | 1/1910 | Rydquist | 15/265 |
| 1,329,410 | 2/1920 | Johnson | 15/265 |
| 1,346,585 | 7/1920 | Arter | 15/265 |
| 1,436,607 | 11/1922 | Roberts | 15/265 |
| 1,486,118 | 3/1924 | Bain | 15/265 |
| 1,527,865 | 2/1925 | Floyd | 15/265 |
| 1,686,133 | 10/1928 | Hill | 15/265 |
| 2,249,247 | 7/1941 | Jones | 12/123 |
| 2,276,741 | 3/1942 | Schelle | 12/123 |
| 2,349,106 | 5/1944 | Mullan | 15/265 |
| 2,357,915 | 9/1944 | Stovall | 15/267 |
| 3,534,426 | 10/1970 | Adkisson, Jr. | 15/267 |
| 4,109,335 | 8/1978 | Randolf | 12/123 |

*Primary Examiner*—Paul T. Sewell
*Assistant Examiner*—Ted Kavanaugh
*Attorney, Agent, or Firm*—Dority & Manning

[57] ABSTRACT

An apparatus for use in shoe shining is provided having a frame, a lower support pivotally mounted on the frame for receiving a shoe, the lower suppport being pivotable upwardly from a position parallel and adjacent to the frame to a horizontal position substantially perpendicular to the frame, a shoe retaining arm pivotally mounted on the frame above the lower support for engaging the inner sole of the shoe at the heel area, the shoe retaining arm being pivotable downwardly to a substantially horizontal position above the horizontal position of the lower support, the shoe retaining arm including a holding element for contacting the inner sole of the shoe at the heel area and the holding element being vertically adjustable to provide a clamping force for securing the shoe onto the lower support.

16 Claims, 4 Drawing Sheets

WALL MOUNTABLE SHOE SHINING APPARATUS

FIELD OF THE INVENTION

The present invention relates to an improved apparatus for the mounting and holding of a shoe while shining same. Variations of the invention include a housing for receipt of apparatus according to the present invention which may be received between studs of a conventional internal wall to be recessed within the wall.

BACKGROUND OF THE INVENTION

Various devices have been disclosed for supporting shoes while shining. Of particular interest is U.S. Pat. No. 4,109,335 to Randolph which discloses a wall mounting bracket having skeletal support and holding structure pivotally secured thereto. The support structure of Randolph is a wire frame that folds outwardly to a horizontal position with the frame having a configuration to receive a shoe thereon and having an offset section to support the heel. The upper pivotal section has a shoe tree which may be inserted into the shoe when the structure is pivoted downwardly. Flexibility of the parts permits use with differing size shoes. Randolph's shoe tree imparts a downward and forward force to hold the shoe in place against the offset where the heel is received. Thus, the shoe is stretched as it is held in place on the support structure.

Also of interest is U.S. Pat. No. 2,357,915 which discloses a vertically extending stand for receiving a shoe. A heel stop is provided along with a vertically adjustable cantilevered clamp that fits into the shoe and holds the shoe against the stand. Other known prior art relating to devices for supporting shoes while shining include U.S. Pat. No. 443,825 to Demme; U.S. Pat. No. 946,464 to Rydquist; U.S. Pat. No. 1,436,607 to Roberts; and U.S. Pat. No. 2,349,106 to Mullan.

While all of the above references disclose a different apparatus for holding shoes during the shining operation, it is believed that the apparatus according to the present invention represents improvement thereover.

Moreover, all of the above prior art disclose only brackets mountable to a wall or the like, and not a housing for shoe supporting apparatus having means for receiving articles commonly employed in the shining of shoes as forms a part of the present invention. Further, no housing for a shoe shine assembly that is dimensionally sized for installation between two wall studs having a thickness receivable within a wall partition has been provided.

SUMMARY OF THE INVENTION

It is an object of the present invention to provide a shoe support apparatus for securing a shoe in place without stretching the shoe during shining.

Another object of the present invention is to provide a shoe support apparatus for supporting a shoe by applying pressure to the heel area only.

Yet another object of the present invention is to provide an improved collapsible support apparatus for supporting a shoe during shining.

Still another object of the present invention is to provide a housing containing a shoe support apparatus for supporting a shoe during shining. Still further, another object of the present invention is to provide a housing containing a shoe support apparatus which is mountable within a wall with a door for concealing the contents of the housing when not in use.

These as well as other objects are achieved by providing an apparatus for use in the shining of shoes having a frame, a support means pivotally mounted on the frame for receiving a shoe, the support means being pivotable upwardly from a position parallel and adjacent to the frame to a horizontal position substantially perpendicular to the frame, a shoe retaining means pivotally mounted on the frame above the support means for engaging the inner sole of the shoe at the heel area, the shoe retaining means being pivotable downwardly to a substantially horizontal position above the horizontal position of the support means, and the shoe retaining means including clamping means for contacting the inner sole of the shoe at the heel area, the clamping means being vertically adjustable to provide a clamping force for securing the shoe onto the support means. Moreover, in a preferred embodiment, a first locking means is provided for releasably locking the support means in its horizontal position and a second locking means is provided for releasably locking the shoe retaining means in its substantially horizontal position.

More specifically, in a most preferred embodiment, a shoe supporting apparatus of the type described above is located within a housing and secured therein. The housing is sized to reside between studs in a conventional internal stud wall of a structure such as a dwelling or an office, and is provided with an access door which may reside flush with adjacent wall surfaces or protrude therebeyond.

DESCRIPTION OF THE PREFERRED EMBODIMENT

An apparatus is provided for aiding a user in the shining of shoes as well as organizing all of the articles required for such a task. The apparatus is mountable within a wall with a door for concealing the contents such that the user may have ready access to all of the items needed for shining shoes as well as a support structure for holding each shoe as it is shined.

Figure 1:
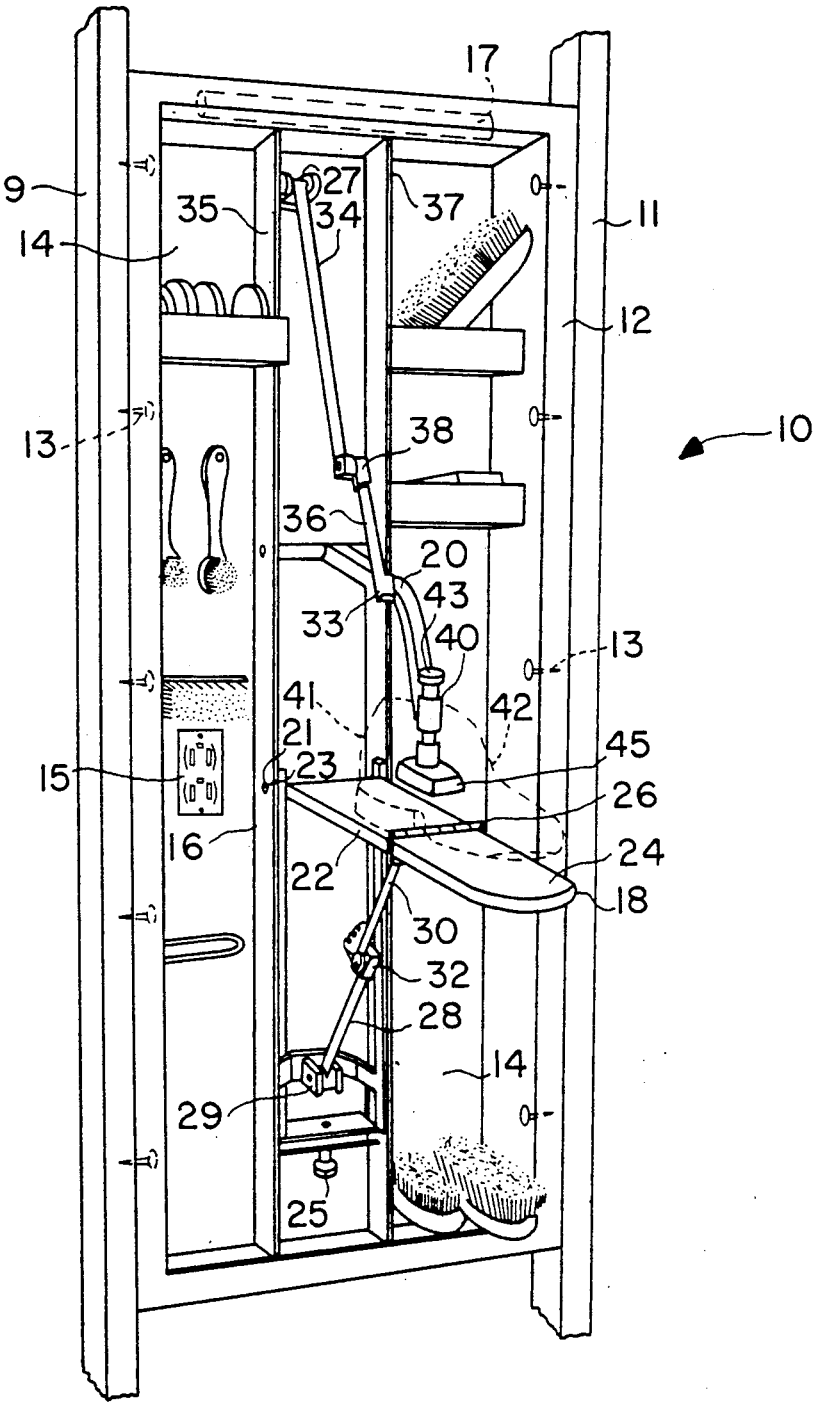
FIG. 1 is a perspective view of a shoe shining apparatus in accordance with the present invention.

Referring to the figures of the drawing, FIG. 1 illustrates an apparatus 10 in accordance with the present invention including housing 12 receivable between wall studs 9 and 11 held therein by a holding means such as screws 13. Various means 14 in the form of compartments for receiving articles employed in shoe shining may be provided as well as other amenities such as electrical receptacle 15 and recessed light 17. Vertical frame 16 is provided on which are mounted a support means such as lower support 18 and a shoe retaining means such as upper shoe retaining arm 20. As is shown in FIG. 1 and best illustrated in phantom in FIG. 2, the entire assembly of lower support 18 is vertically slidable within frame 16 on lower support frame 19 with protrusions 21 of frame 19 slidably carried in slot 23 of frame 16. Preferably, support frame 19 has a limited range of vertical movement with respect to frame 16 determined by the length of slot 23 such that it is adjustable by some means such as set screw 25 so that support 18 may be adjusted to accommodate shoes of various sizes as will be discussed in greater detail below.

Figure 4:
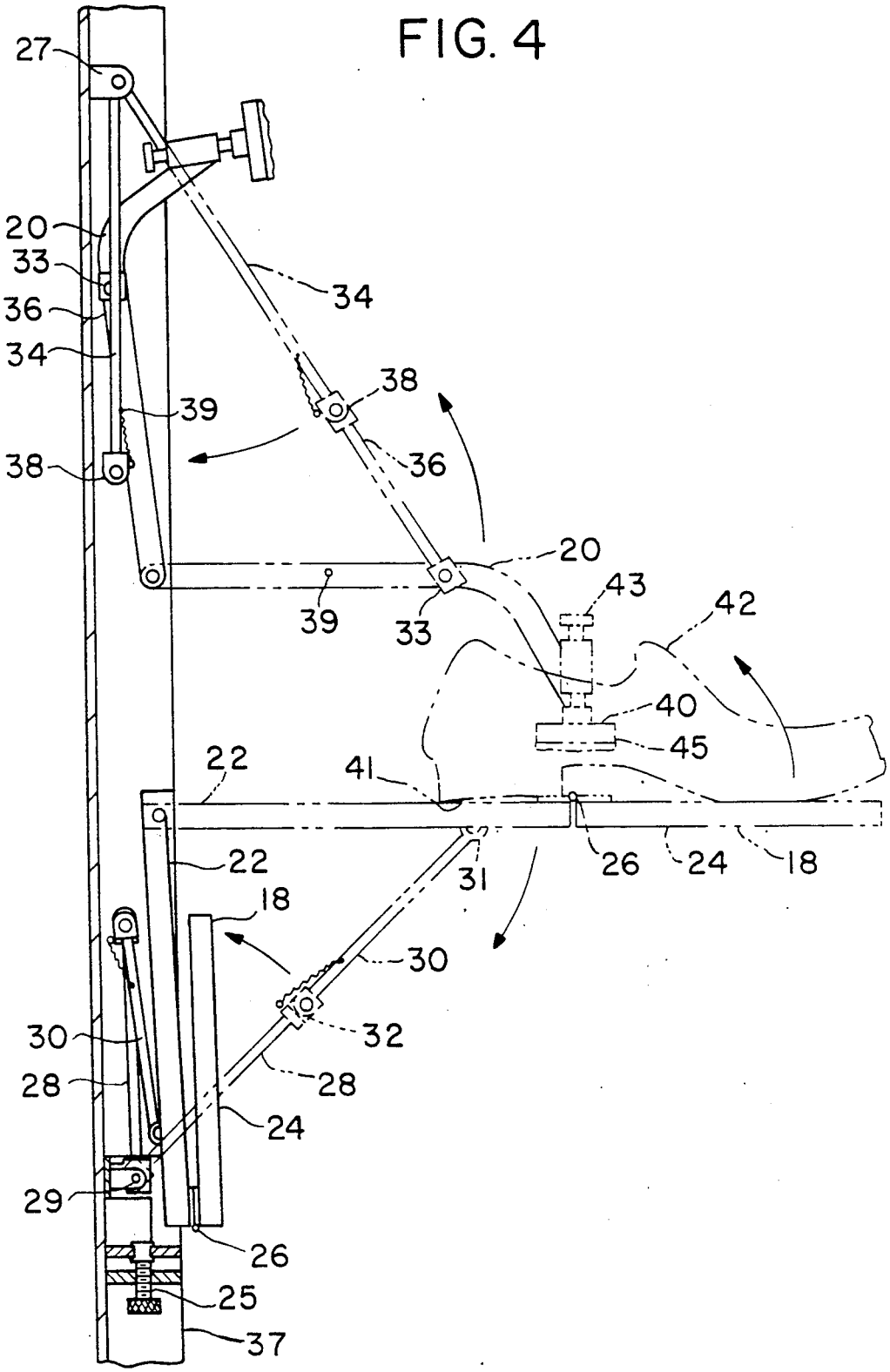
FIG. 4 is a side view of the support and upper retaining arm of the present invention in their respective retracted positions and, in phantoms, in their opened, substantially horizontal, positions holding a shoe for shining.

Lower support 18 pivots upwardly from a position parallel and adjacent to the vertical frame to a horizontal position which is substantially perpendicular to the vertical frame. As is seen in FIGS. 1 and 4, the lower support is preferably constructed of two panels such as 22 and 24 which are hingedly connected as at 26 such that when lifted to the horizontal position, panel 24 is folded outwardly and is held by a means, such as a stop, in linear alignment with panel 22 such that the lower support presents a substantially planar surface for receiving a shoe. Support bars 28 and 30 are pivotally connected at joint 32 with bar 28 pivotally carried on the frame 19 at joint 29, and bar 30 pivotally connected to panel 22 at joint 31. Support bars 28 and 30 provide a first locking means as they lock into place at joint 32 when the lower support is pivoted into the horizontal position. As is best seen in FIG. 4, when the lower support is pivoted downwardly toward the position parallel to the vertical panel, support bars 28 and 30 pivot at joint 32 out of linear alignment, with support bar 28 approaching the vertical panel and support bar 30 approaching the underside of the lower support. Joint 32 is spring loaded, biasing the support bars into their closed positions, but locks into place when the bars are in axial alignment.

Figure 2:
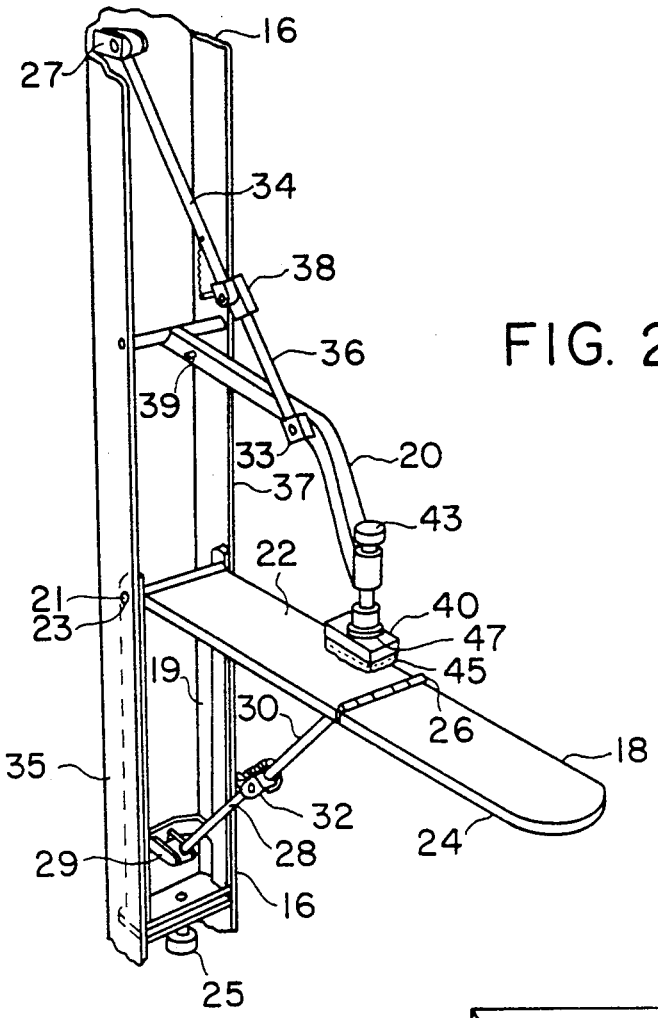
FIG. 2 is a perspective view of the support, upper retaining arm and holding element of the present invention.

The structure of the upper retaining arm 20 is best illustrated in FIGS. 2 and 4. The upper retaining arm pivots downwardly from a position substantially parallel to the vertical panel to a substantially horizontal position above the horizontal position of the lower support. Support bar 36 is pivotally connected to arm 20 at joint 33 and to support bar 34 at joint 38. Support bar 34 is pivotally carried by the frame at joint 27. In the substantially horizontal position, support bars 34 and 36 are locked in linear alignment at joint 38. Like joint 32 above, joint 38 is spring loaded, biasing the support bars 34 and 36 into their closed positions, but also locks the bars into place when they are in axial alignment when the retaining arm is pivoted into its substantially horizontal position. As is best shown in the side view of FIG. 4, when the retaining arm is pivoted upwardly, these bars pivot at joint 38 with support bar 34 approaching the vertical panel and support bar 36 approaching the retaining arm. A stop 39, illustrated in FIGS. 2 and 4, is preferably provided on retaining arm 20 to retain the support bars 34 and 36 within the frame when they are in the folded, vertical position. It is readily understood from FIG. 4 that, in this closed position, the support bars have a tendency to extend outwardly from the frame with bar 36 pivoting outwardly at joint 33 and bar 34 pivoting outwardly at joint 27 such that joint 38 is extended forward of the retracted retaining arm 20. Stop 39 precludes this forward extension by holding support bar 36 and, thus, support bar 34 back in their folded, vertical positions. It is also understood from FIG. 4 that no analogous stopping means is required to retain the lower support bars 28 and 30 within the frame as those bars are held in by panel 22.

A clamping means in the form of holding element 40 is carried through the distal end of the upper retaining arm. As is shown in FIG. 1, that distal end, when the retaining arm is pivoted downwardly over the lower support having a shoe thereon, is located directly above the heel portion 41 of the shoe 42. The holding element, comprised preferably of set screw 43 and holding pad 45, contacts the inner sole of the shoe at the heel area and is adjustable by the user to create a clamping force securing the shoe onto the lower support for shining. Most preferably, holding element has a swivel action at 47 such that holding pad 45 does not rotate upon contact with the inner sole of the shoe as the set screw 43 is screwed downwardly to increase the clamping force or upwardly to release the clamping force. The clamping action of element 40 acts in conjunction with the vertical adjustability of lower support arm 18 such that for a shoe having a substantially flat heel it may be necessary to upwardly adjust the lower support frame 19 until the protrusions 21 of that frame abut the upper edge of the slots 23 of frame 16 and to downwardly adjust the holding pad 45 with set screw 43. Conversely, when a shoe with a relatively thick heel is to be shined, the lower support assembly may be lowered and element 40 may be adjusted accordingly.

As is shown in FIG. 1, the vertical frame 16 is channeled with forwardly protruding outer ridges 35 and 37 such that upon collapse of the lower support from its horizontal position to the position parallel and adjacent the frame and upon collapse of the upper shoe retaining arm from its substantially horizontal position to its position substantially parallel to the vertical frame, both the lower support and the upper shoe retaining arm are within the dimensions of ridges 35 and 37. This feature is not so important in the embodiment of FIG. 1 as it is in an embodiment like that of FIG. 2 wherein the frame carrying the lower support and the upper retaining arm alone is mounted to a wall or the like such as the wall of a shoe shine stand with ridges 35 and 37 provided to shield lower support and upper retaining arm from accidental side blows. Again, lower support frame 19 is carried within frame 16 and is vertically adjustable therein.

Figure 3:
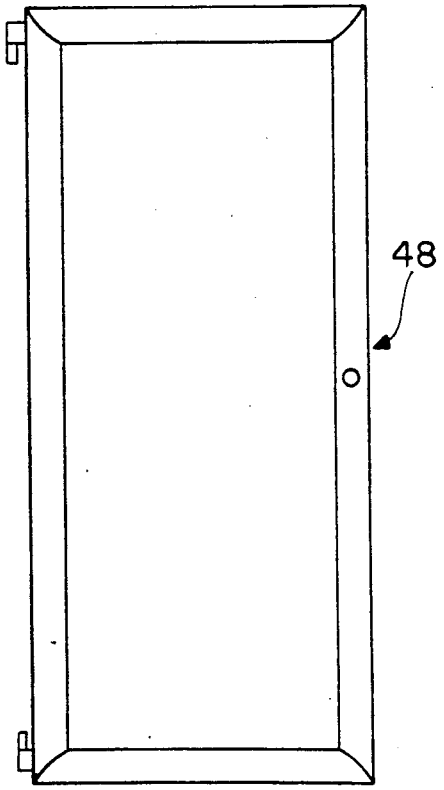
FIG. 3 is a front view of the apparatus of the present invention installed within a wall with a door for concealing the contents thereof.

FIG. 3 shows the housing of the present invention installed within a wall such that only a cabinet-like door is visible concealing the contents therein. Preferably the housing is sized for easy installation between two wall studs having a thickness which is receivable within a normal wall partition as found in a home. Door 48 is provided to conceal the contents of the housing such that when closed the apparatus appears as a conventional cabinet.

Thus, the user may simply open the door, lift and extend the lower support, place a shoe on the lower support, lower the retaining arm and secure the shoe at the heel to the lower support for shining. Although not shown in the figures of the drawing, vertical frame 16 may be slidably carried within the housing for adjustment of the height of shining. The items needed for shining including brushes, cloths and polish are all housed within the various members 14. When the user has completed his shining task, the lower support and upper retaining arm are pivoted back into their storage positions substantially parallel to the vertical panel and the door is closed to conceal the contents of the housing.

Figure 5:
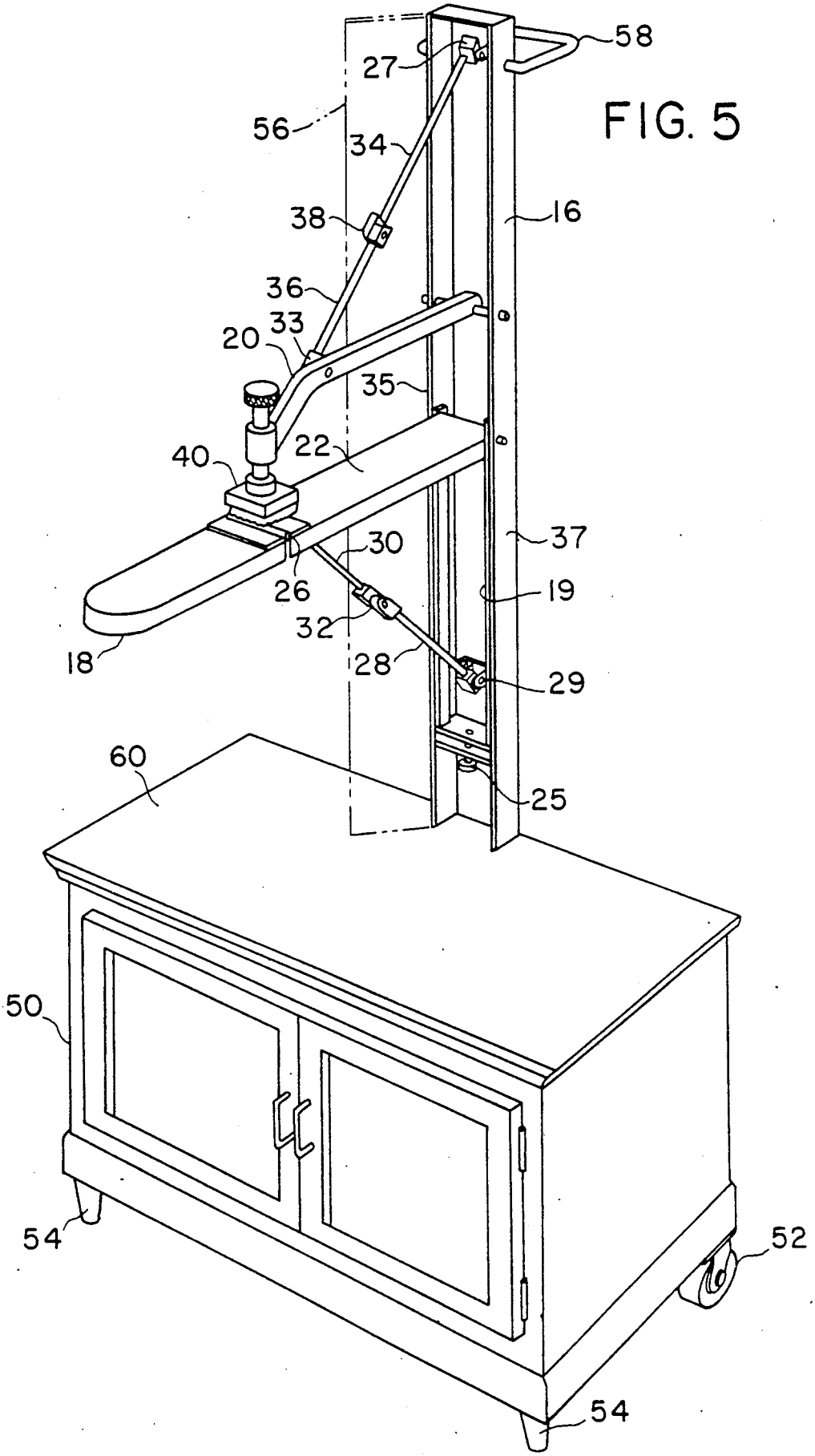
FIG. 5 is a perspective view of a shoe shine stand in accordance with the present invention.

Alternatively, channeled frame 16, having lower support 18 and upper retaining arm 20 mounted therein, may be mounted to a shoe shine stand as is represented in FIG. 5. The shoe shine operator may keep his supplies concealed within cabinet 50. In the embodiment of FIG. 5, cabinet 50 has rear wheels 52 and support means in the form of forward legs 54 such that the shoe shine stand is portable but may be readily securely set in a propitious location for business. Alternatively, the cabinet may have both forward and rear wheels with locking means on the wheels providing support means to preclude movement of the stand. When the lower support and upper retaining arm are folded into their vertical, closed positions, a door 56 carried on frame 16 may be closed to conceal and protect the contents of the frame. The shoe shine operator thus may pull his portable stand by handle 58 to another location at which door 56 is opened, lower support 18 and upper retaining arm 20 are extended to their working positions and shoe shining supplies are removed from cabinet 50 and arranged on cabinet top 60 for easy access. As with the other embodiments discussed heretofore, a customer's shoe is positioned on lower support 18 as described above and held thereto with upper retaining arm 20 and holding element 40. This places the shoe in a better shining position for the operator allowing him to provide the customer a faster and more thorough shoe shine than when he attempts to shine the shoe on the customer's foot or while holding it himself.

These and other modifications and variations to the present invention may be practiced by those of ordinary skill in the art, without departing from the spirit and scope of the present invention, which is more particularly set forth in the appended claims. Furthermore, those of ordinary skill in the art will appreciate that the foregoing description is by way of example only, and is not intended to be limitative of the invention so further described in such appended claims.

That which is claimed is:

1. An apparatus for use in shoe shining comprising:

a vertical frame;

support means pivotally mounted on said vertical frame for receiving a shoe;

said support means being pivotable between a position parallel and adjacent to the frame and a horizontal position substantially perpendicular to the frame;

shoe retaining means pivotally mounted on said vertical frame above said support means for engaging the inner sole of the shoe at the heal area;

said shoe retaining means being pivotable between a position parallel and adjacent the frame and a substantially horizontal position above the horizontal position of the support means;

said shoe retaining means including clamping means for contacting the inner sole of the shoe at the heel area; and the clamping means being vertically adjustable to provide a clamping force for securing the shoe onto the support means.

2. The apparatus set forth in claim 1 further including:

a first locking means for releasably locking the support means in said horizontal position; and a second locking means for releasably locking the shoe retaining means in said substantially horizontal position.

3. The apparatus set forth in claim 1 wherein said frame is channeled with forwardly protruding outer ridges such that upon collapse of said lower support from said horizontal position and upon collapse of said upper shoe retaining arm from said substantially horizontal position the lower support and the upper shoe retaining arm are contained within the channeled frame.

4. The apparatus set forth in claim 1 wherein said support means is carried on a support frame, vertically slidable within said vertical frame, such that said support means is vertically adjustable for accommodating shoes of varying height.

5. An apparatus for use in shoe shining, comprising:

a mountable housing;

a vertical frame within the housing;

a lower support pivotally mounted on the vertical frame;

the lower support being pivotable upwardly from the position parallel and adjacent to the vertical frame to a horizontal position substantially perpendicular to the vertical frame;

a first locking means for releasably locking the lower support in said horizontal position;

the lower support presenting a substantially planar surface for receiving a shoe in said horizontal position;

an upper shoe retaining arm pivotally mounted on the vertical frame above the lower support and being pivotable from an upward substantially vertical position downwardly to a substantially horizontal position above the horizontal position of the lower support;

a second locking means for releasably locking the upper shoe retaining arm in said substantially horizontal position;

a holding element carried by the upper shoe retaining arm for engaging the inner sole of the shoe at the heel area;

said holding element being vertically adjustable to provide a downward holding force for securing the shoe onto the lower support for shining.

6. The apparatus set forth in claim 5 wherein said vertical frame is channeled with forwardly protruding outer ridges such that upon collapse of said lower support from said horizontal position and upon collapse of said upper shoe retaining arm from said substantially horizontal position the lower support and the upper shoe retaining arm are contained within the channeled frame.

7. The apparatus set forth in claim 5 further including means for receiving articles employed in shoe shining.

8. The apparatus set forth in claim 5 herein said housing is dimensionally sized for installation between two wall studs having a thickness receivable within a wall partition.

9. The apparatus set forth in claim 5 further including a door on the housing for concealing the interior thereof when not in use.

10. The apparatus set forth in claim 5 wherein the holding element is threadably disposed through the distal end of the upper retaining arm.

11. A portable shoe shine stand, comprising:

storage means for housing supplies;

a vertical frame mounted on said storage means;

support means pivotally mounted on said vertical frame for receiving a shoe;

said support means being pivotable between a position parallel and adjacent to the frame and a horizontal position substantially perpendicular to the frame;

shoe retaining means pivotally mounted on said vertical frame above said support means for engaging the inner sole of the shoe at the heel area;

said shoe retaining means being pivotable between a position parallel and adjacent the frame and a substantially horizontal position above the horizontal position of the support means; and, wheels mounted on said storage means for moving the shoe shine stand.

12. Apparatus for use in shoe shining, comprising:

a mountable housing;

a vertical frame within the housing;

the lower support pivotally mounted on the vertical frame;

the lower support being pivotable upwardly from a position parallel and adjacent to the vertical frame to a horizontal position substantially perpendicular to the vertical frame;

a first locking means for releasably locking the lower support in said horizontal position;

the lower support presenting a substantially planar surface for receiving a shoe in said horizontal position;

said lower support also being adjustable in the vertical direction along said vertical frame;

an upper shoe retaining arm pivotally mounted on the vertical frame above the lower support and being pivotable from an upward substantially vertical position downwardly to a substantially horizontal position above the horizontal position of the lower support;

a second locking means for releasably locking the upper shoe retaining arm in said substantially horizontal position;

a holding element carried by the upper shoe retaining arm for engaging the inner sole of the shoe at the heel area;

said holding element being vertically adjustable to provide a downward holding force for securing the shoe onto the lower support for shining.

13. The shoe shine stand set forth in claim 11 wherein said wheels are mounted on a rear portion of said storage means for moving the shoe shine stand.

14. The shoe shine stand set forth in claim 13 further including legs mounted on a forward portion of said storage means for precluding movement of said stand.

15. The shoe shine stand set forth in claim 11 further including locking means associated with said wheels for precluding movement of the stand.

16. The shoe shine stand set forth in claim 11 further including a handle carried on said frame.

* * * * *